United States Patent [19]

Batt et al.

[11] 4,003,775

[45] Jan. 18, 1977

[54] METHOD FOR MAKING A GARMENT

[75] Inventors: Richard A. Batt; Charles B. Green, both of Lewisburg, Pa.

[73] Assignee: International Paper Company, New York, N.Y.

[22] Filed: Dec. 5, 1974

[21] Appl. No.: 529,713

Related U.S. Application Data

[63] Continuation of Ser. No. 322,722, Jan. 11, 1973, abandoned.

[52] U.S. Cl. ..... 156/226; 156/227; 156/256

[51] Int. Cl.[2] ..... B31F 1/00

[58] Field of Search ..... 156/201, 202, 204, 227, 156/256, 270, 291, 297, 226; 2/48, 49 R, 52, 243 R, 243 B, 275

[56] References Cited

UNITED STATES PATENTS

| | | | |
|---|---|---|---|
| 1,618,208 | 2/1927 | Lichter | 2/275 |
| 1,657,868 | 1/1928 | Segal | 2/52 |
| 1,674,904 | 6/1928 | Kemp | 2/48 |
| 2,377,747 | 6/1945 | Berkowitz | 2/48 |
| 2,763,867 | 9/1956 | Chagnon | 2/49 R |
| 2,830,297 | 4/1958 | Sabee | 2/49 R |
| 3,359,149 | 12/1967 | Hummel | 156/204 |
| 3,619,816 | 11/1971 | Cowen | 2/49 R |
| 3,684,611 | 8/1972 | Craig | 2/243 R |
| 3,801,985 | 4/1974 | Batt | 2/48 |

*Primary Examiner*—Charles E. Van Horn
*Assistant Examiner*—Basil J. Lewris
*Attorney, Agent, or Firm*—Ronald A. Schapira

[57] ABSTRACT

A method for automatically producing bib aprons from a continuous web of nonwoven fibrous material. The web is unwound from a supply roll, and beads of adhesive are applied adjacent its longitudinal edges as it is advanced along a feed path. The edges are then folded over the adhesive to provide longitudinal reinforcements, and the web is cut in a direction transverse to its direction of movement to form rectangular blanks. As the blanks continue along the feed path, additional beads of adhesive are applied to each blank in spaced areas adjacent a pair of opposed corners. To produce the neck loop and tie elements for the apron, a single narrow strip of nonwoven fibrous material is positioned over the blank in a direction transverse to its direction of movement, and the center of this strip is pulled in the direction of movement such that the strip forms both the neck loop and the tie elements. The opposed corners of the blank are folded over the adhesive areas to hold the strip in place. The completed apron is then folded longitudinally and transversely for stacking and packaging.

3 Claims, 5 Drawing Figures

FIG. 2.
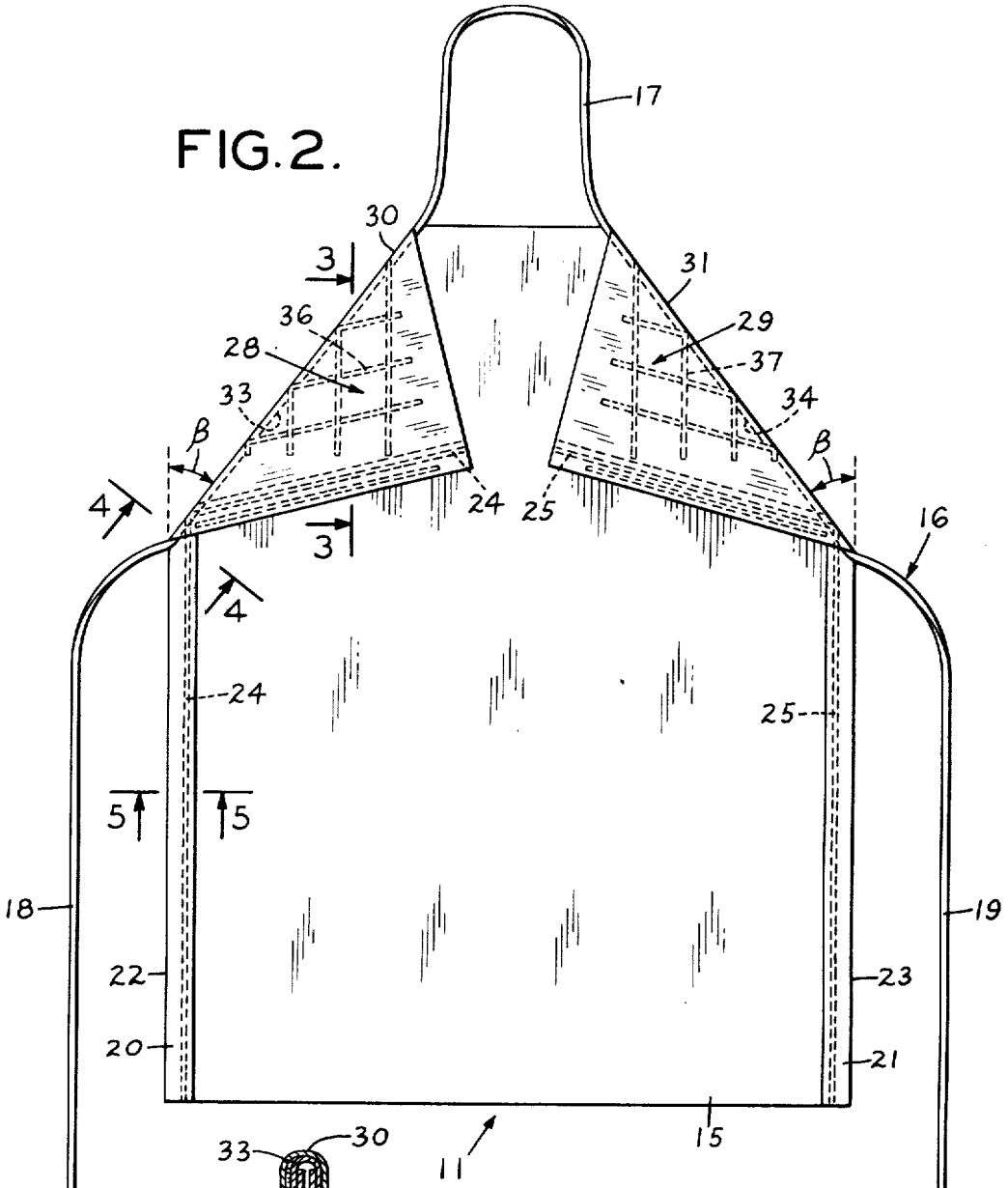
FIG. 3.
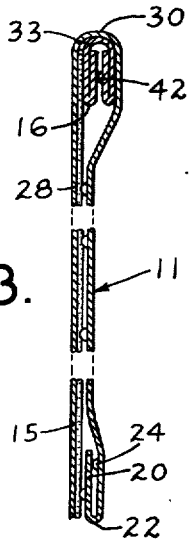
FIG. 4.
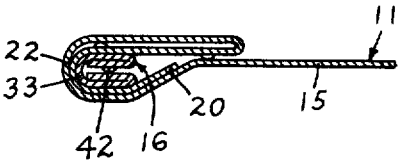
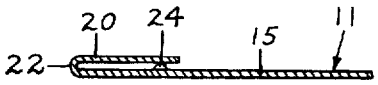
FIG. 5.

METHOD FOR MAKING A GARMENT

This is a continuation, of application Ser. No. 322,722, filed Jan. 11, 1973, now abandoned.

BACKGROUND OF THE INVENTION

This invention relates to the manufacture of garments and more particularly to a method for making a garment from nonwoven fibrous material.

The present invention, while of general application, is particularly well suited for use in the manufacture of bib aprons of the type having a continuous strip of material which serves as both a neck loop and as tie elements for the apron. The strip passes through folded corner portions of the apron and is of a length sufficient to permit the tying of the tie elements either in back or in front of the wearer. One particularly advantageous apron of this character is disclosed in the copending United States patent application by Richard A. Batt filed concurrently herewith, now U.S. Pat. No. 3,801,905.

Heretofore, difficulties have been encountered in the manufacture of bib aprons and related garments through the use of mass production techniques. As an illustration, it was often necessary, in previous processes employed for this purpose, to produce the garments on a piece work basis, with at least some of the cutting, folding, fastening and transporting operations being performed in a more or less manual fashion. The remaining operations for the most part necessitated the use of quite complicated machinery which was difficult and expensive to obtain and was occasionally unreliable in use. In addition, and this has been of special moment in the manufacture of garments of the bib apron type, problems arose heretofore in the assembly and fastening of the neck loops and tie elements to the main body portions of the garments.

SUMMARY

One general object of this invention, therefore, is to provide a new and improved method for manufacturing garments on a mass production basis.

More specifically, it is an object of this invention to provide such a method in which the garments are produced from a continuous web of material in a rapid and staightforward manner.

Another object of this invention is to provide a method of the character indicated which is readily adaptable to the use of comparatively simple automated machinery.

A further object of the invention is to provide a method for rapidly and economically making a bib apron.

In one illustrative embodiment of this invention, a continuous web of nonwoven fibrous material is unwound from a supply roll and is directed along a feed path. The longitudinal edges of the web are folded over and secured to the adjacent web portions to provide parallel reinforcements. The web is then cut in a direction transverse to its direction of movement to form a rectangular blank. A narrow strip of material is positioned across the blank and is uniquely oriented such that when two of the opposed corners of the blank are folded over portions of the strip and are attached to the body of the blank, the strip is firmly held in place. A plurality of longitudinal folds are then produced in the thus completed garment as it continues its movement along the feed path, and this is followed by a single transverse fold to provide a size sufficient for stacking and packaging.

In accordance with one feature of the invention, in certain particularly advantageous embodiments, the material for the main body portion of the garment is automatically advanced from its supply roll in the form of a single continuous web. The various folding, cutting and fastening operations also are performed on an automated basis as the material proceeds along its feed path to form the finished garment and to fold the garment to a size sufficient for stacking and packaging. The garments are produced in an extremely rapid and straightforward manner, and the degree of uniformity from one garment to another is substantially improved.

In accordance with another feature of the invention, in several important embodiments, the fastening operations for both the edge reinforcements and the opposed corners of the garment are performed through the use of adhesive. In each case the adhesive is arranged along lines parallel to the direction of travel of the material. As a result, the adhesive applying machinery may be greatly simplified, and the connections are much stronger than would otherwise be the case.

In accordance with a further feature of certain advantageous embodiments of the invention, the narrow strip is arranged such that it forms both the neck loop and the tie backs for the garment. The strip is first positioned across the rectangular blank in a direction perpendicular to its direction of movement, and the center portion of the strip is then pulled relative to the adjacent portions in the direction of movement to form a V. The apex of the V comprises the neck loop, and the legs comprise the tie backs. Upon the folding and securing of the opposed corner portions of the blank, the strip is affirmatively held in place in its proper location.

In accordance with still another feature of the invention, in some embodiments, only a single straight-line cut is needed for each garment, and this cut extends in a direction transverse to the direction of movement of the web. Because of the absence of curved or angularly extending cuts, the overall manufacturing process is greatly simplified.

The present invention, as well as further objects and features thereof, will be understood more clearly and fully from the following description of a preferred embodiment, when read with reference to the accompanying drawings.

BRIEF DESCRIPTION OF THE DRAWINGS

FIG. 2 is a rear view of a completed apron produced in accordance with the method of FIG. 1.

FIG. 3 is an enlarged fragmentary sectional view taken along the line 3—3 in FIG. 2.

FIG. 4 is an enlarged fragmentary sectional view taken along the line 4—4 in FIG. 2.

FIG. 5 is an enlarged fragmentary sectional view taken along the line 5—5 in FIG. 2.

DETAILED DECRIPTION OF A PREFERRED EMBODIMENT

Figure 1:
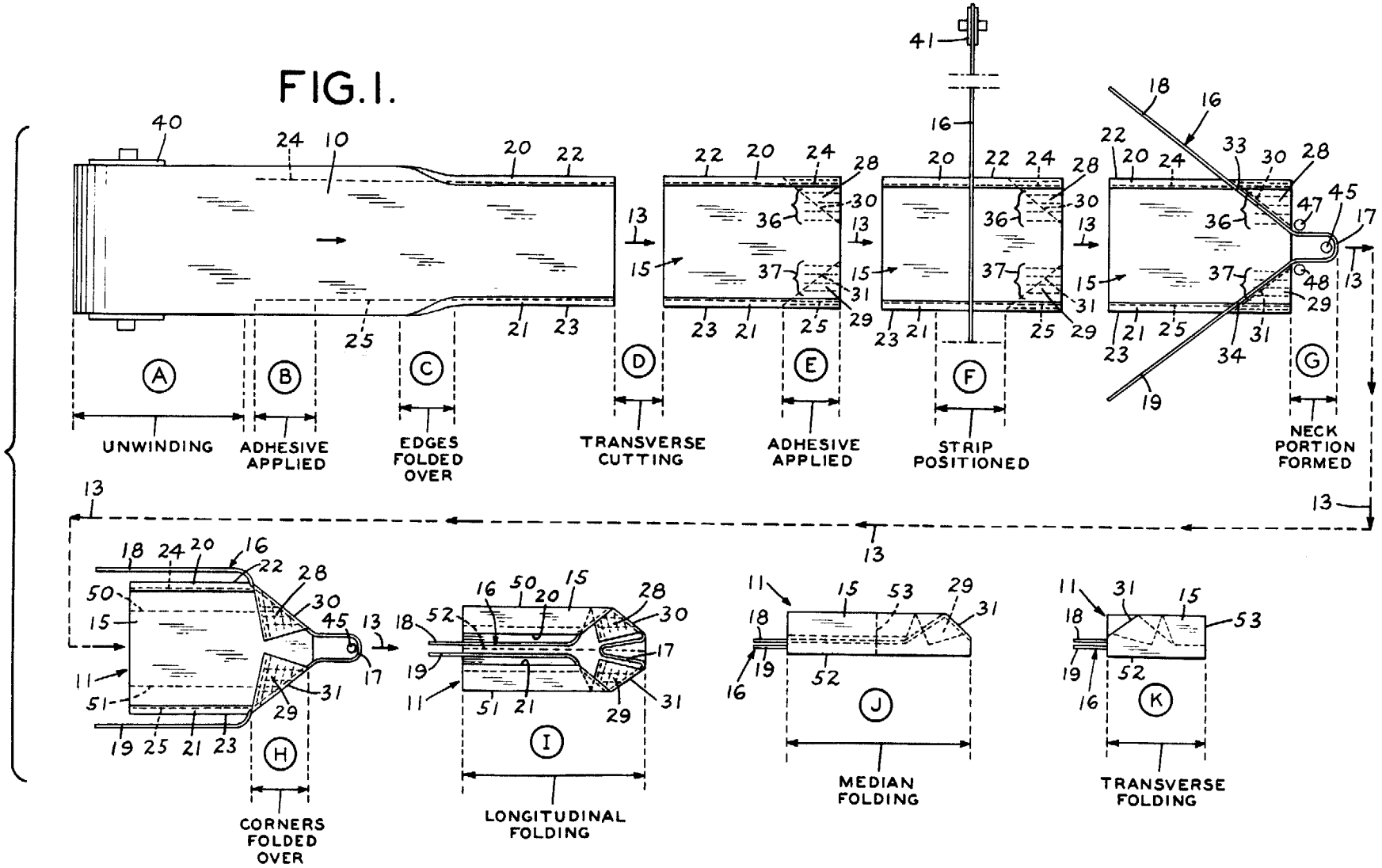
FIG. 1 is a schematic plan view showing the successive steps in the manufacture of bib aprons in accordance with an illustrative embodiment of the invention.

Referring to FIG. 1 of the drawings, there is shown a continuous web 10 from which is produced a series of bib aprons 11. The apron material undergoes eight successive manufacturing operations, indicated schematically in FIG. 1 by the letters A through H, as it is automatically advanced along a feed path represented by arrows 13. Thereafter, and to facilitate stacking and packaging, the completed aprons are subjected to successive longitudinal folding steps I and J and a transverse folding step K as they proceed along the feed path. The thus folded aprons are led to a suitable packaging machine (not shown) where they are prepared for shipment.

The aprons 11 are best shown in FIGS. 2-5. Each apron includes a main body portion formed from a rectangular blank 15 and a single cord or strip 16. In the illustrated embodiment both the blank 15 and the strip 16 advantageously are made from nonwoven felted fibrous material, although in other arrangements various woven fabrics, nonporous materials such as polyethylene, rubber, etc., may be employed with good effect. The strip 16 serves as both a neck loop 17 and as tie elements 18 and 19 for the apron and is of a length sufficient to enable the tie loops to be secured either behind or in front of the wearer. The blank 15 includes longitudinal edge portions 20 and 21. These edge portions are folded over the main body portion of the blank along respective fold lines 22 and 23 and are adhesively held in place by beads of adhesive represented schematically by lines 24 and 25. The portions 20 and 21 serve as reinforcements for the longitudinal edges of the garment.

A pair of triangular corner portions 28 and 29 of the blank 15 are defined by respective fold lines 30 and 31. The corner portions 28 and 29 are folded over the body of the blank with the adjacent portions 33 and 34 of the strip 16 therebetween and with the neck or loop portion 17 of the strip protruding above the apron. The corner portions are held in place by spaced groups 36 and 37 of adhesive bond lines. As will become more fully apparent from the ensuing discussion, these lines comprise beads of adhesive which are applied to the blank such that each line extends in a direction parallel to the blank's longitudinal dimension. When the corner portions are folded over, however, the lines produce the gridlike array illustrated in FIG. 2.

The continuous web 10 from which the apron is made emanates from an unwind stand illustrated schematically at 40 (FIG. 1, Step A). As the web proceeds along the feed path 13, it passes beneath a suitable glue machine (not shown) having dispenser units mounted in stationary positions adjacent the web's longitudinal edge portions 20 an 21, respectively. These units apply spaced beads of adhesive to the web (Step B) to form the adhesive lines 24 and 25. The adhesive preferably is heated prior to its application in order to reduce its viscosity and thus increase the flowability of the adhesive onto the web. It will be noted from FIG. 1 that the lines 24 and 25 extend in directions parallel to the web's direction of movement along the feed path.

Upon continued movement of the web 10 along the feed path 13, the longitudinal edge portions 20 and 21 are folded along the fold lines 22 and 23 and over the adhesive lines 24 and 25 (Step C). The edge portions are pressed against the lines 24 and 25 to firmly bond them to the main body portion of the web. The thus produced folds provide double thicknesses of material to form parallel stiffening reinforcements along the longitudinal edges of the web.

Following the folding of the longitudinal edge portions 20 and 21, the web 10 is cut (Step D) to produce the rectangular blank 15. The cut extends along a straight line in a direction transverse to the direction of movement along the feed path 13. This cut is the only cutting opeation performed on the web during the manufacture of the garment. By eliminating the need for curved cuts or cuts which extend at acute angles with repect to the feed path, the overall manufacturing procedure is greatly simplified.

As the blank 15 proceeds along the feed path, additional beads of adhesive are applied adjacent its forward portion to form the spaced groups 36 and 37 of bond lines. As indicated heretofore, and as best illustrated at Step E in FIG. 1, the groups 36 and 37 are respectively located adjacent the opposed corner portions 28 and 29 with each of the bond lines extending in a direction parallel to the direction of movement along the feed path. The lines are laid down as the leading edge of the blank moves beneath the glue dispenser units and proceeds for a distance of about one foot along the feed path. In the embodiment shown in FIG. 1 there are five lines in each group with approximately 2 inches between adjacent lines. Each of the lines illustratively is 10 inches long with the exception of the outside lines which have a length of 12 inches.

The successive cords or strips 16 for the aprons are produced from a single length of material. In a preferred form the strips 16 are of nonwoven felted fibrous material, but they may be made from woven fabric or from suitable tape, string, cord, etc. As the adhesive lines are applied to the blank 15 to form the groups 36 and 37, the material for the strips 16 is unwound from a suitable cylinder 41 and is folded lengthwise in the manner illustrated in FIGS. 3 and 4. Adhesive beads 42 serve to hold the folds together and form the completed strip. The strip passes between appropriate cooling rollers (not shown) and is advanced toward the feed path 13.

As illustrated at F in FIG. 1, the incoming strip 16 is positioned across the rectangular blank 15 so that the strip extends in a direction perpendicular to the blank's direction of movement along the feed path 13. In this position the strip is disposed a short distance above the plane of the blank. The center portion 17 of the strip is then engaged by a depending member 45. The member 45 is advanced relative to the blank along the feed path 13 and is effective to carry the center portion 17 between two stationary guide rods 47 and 48 (Step G). As the portion 17 moves between the guide rods, the strip becomes oriented in the form of a V with the adjacent strip portions 33 and 34 extending diagonally across the respective bond line groups 36 and 37 and with the tie elements 18 and 19 protruding on opposite sides of the blank.

As best shown in FIG. 2, the strip portions 33 and 34 are arranged such that they each form an included angle $\beta$ with the corresponding longitudinal edge of the blank 15, when measured with respect to the direction of movement of the blank along its feed path. In the illustrated embodiment this angle is approximately 37°, and for best results the angle should not exceed about 45°. If the angle is much in excess of 45°, the tie elements 18 and 19 will exit from the blank 15 too close to the forward or upper edge of the blank, with the result that the elements will be uncomfortably high, i.e., too far above the waist of the wearer.

Following the formation of the neck loop portion 17, the opposed corner portions 28 and 29 of the blank 15 are folded over in the manner illustrated at H in FIG. 1.

As the portions 28 and 29 are turned back on the respective fold lines 30 and 31, the adhesive lines forming each of the groups 36 and 37 intersect one another to provide a generally gridlike configuration. The portions 28 and 29 are pressed into contact with the adhesive lines to secure the corner portions 28 and 29 to the body of the blank 15. The strip 16 is cut to length, and the depending member 45 returns to its initial position to receive the succeeding strip. During the return of the member 45, it carries the neck loop 17 back over the blank to the position shown at I.

The fold lines 30 and 31 are oriented at the same angle $\beta$ (FIG. 2) as the strip portions 33 and 34. With this arrangement, the portions 33 and 34 are disposed within the folds and are firmly held in place. The groups 36 and 37 of adhesive lines are spaced from the areas where the neck loop 17 and the tie elements 18 and 19 exit from the blank 15, such that in the completed garment the strip 16 is free to move relative to the fold lines 30 and 31 in these areas. One advantage of this arrangement is that, when the strip is tied by the wearer or otherwise placed under tension, the garment material will gather and bunch together in the areas where the neck loop 17 and the tie elements 18 and 19 exit. The bunching effect increases the thickness of the material in these areas and substantially reduces the possibility of the material being torn by the strip.

As the thus completed apron 11 proceeds along the feed path 13, two longitudinal folds 50 and 51 are made (Step I) to reduce the overall size of the garment. In the illustrated embodiment, each of these folds is located approximately five inches from the adjacent longitudinal edge 20 or 21. During the ensuing step J, the garment is again folded in the longitudinal direction along its center line to produce a median fold 52.

The longitudinally folded garment proceeds to a suitable guillotine folder (not shown) at station K. The folder contacts the garment along its transverse center line to produce a transverse fold 53. The thus completed and folded garment is then stacked and packaged for shipment.

Each of the various steps in the manufacture of the garments may be readily performed by comparatively straightforward, fully automated equipment. Production rates as high as 10 to 15 aprons per minute may be achieved even with comparatively standard equipment, and the production rate may be further increased through the use of more sophisticated high-speed machinery.

Garments manufactured in accordance with the invention may vary widely in size. Although the following dimensions produce highly satisfactory bib aprons giving a maximum of protection and wearing comfort to an individual of average height and weight, it will of course be recognized that the particular dimensions used may vary widely from these specific figures.

| | |
|---|---|
| Width of apron blank 15 | 30" |
| Length of apron blank 15 | 36" |
| Width of apron 11 | 28" |
| Length of bottom edge of each folded corner portion 28 and 29 | 13" |
| Length of longitudinal edge of each folded corner portion 28 and 29 | 10" |
| Angle $\beta$ | approx. 37° |
| Width of blank for strip 16 | 1½" |
| Width of folded strip 16 | ½" |
| Length of strip 16 | 82" |
| Length of neck loop 17 | 22" |

In the illustrated embodiment the adhesive used in each of the joining steps advantageously is a hot melt adhesive, i.e., one solid at normal room temperature and heated to fluidity to apply. In other good arrangements, cold adhesives may be employed with good effect.

The terms and expressions which have been employed are used as terms of description and not of limitation, and there is no intention in the use of such terms and expressions of excluding any equivalents of the features shown and described or portions thereof, but it is recognized that various modifications are possible.

What is claimed is:

1. In a method for making a garment (11) from a continuous web (10) of material, during movement of the web (10) along a feed path (13), which comprises the steps of: directing the web (10) along the feed path (13); cutting the web in a predetermined direction to form a blank (15); providing a strip (16) of material having a generally V configuration above the blank (15) with: a center portion (17) of the strip (16) protruding from the blank (15), end portions (18) and (19) of the strip (16) protruding from opposite sides of the blank, and leg portions (33 and 34) of the V configured strip (16), between the center portion (17) and the end portions (18 and 19) thereof, being positioned adjacent opposed corner portions (28 and 29) of the blank; folding the opposed corner portions (28 and 29) of the blank (15) over the adjacent leg portions (33 and 34) of the strip (16) and into overlying relationship with portions of the body of the blank (15) on the other side of the leg portions of the strip; and securing the corner portions (28 and 29) to the underlying body portions of the blank (15) to maintain the strip (16) in a fixed relationship with the blank; the improvement in providing the strip (16) with a generally V-configuration above the blank (15), which comprises:

positioning the strip (16) across the blank (15), so that the strip extends in a direction perpendicular to the blank's direction of movement along the feed path (13), with the end portions (18 and 19) of the strip (16) protruding from the opposite sides of the blank (15); and then moving the center portion (17) of the strip (16) with a depending member (45) in the blank's direction of movement along the feed path (13) and through two spaced guides (47 and 48) located along the feed path between the opposite sides of the blank (15), so that: the strip (16) has the generally V-configuration, its center portion (17) protrudes from the blank (15), and its leg portions (33 and 34) are positioned adjacent the opposed corner portions (28 and 29) of the blank (15).

2. The method of claim 1 wherein the overlying corner portions (28 and 29) of the blank (15) and the underlying body portions of the blank (15) are secured with an adhesive on their adjacent surfaces and wherein the leg portions (33 and 34) of the strip (16) are moved across the adhesive on the body portions of the blank (15) when moving the center portion (17) of the strip (16) to provide the generally V-configuration of the strip (16).

3. The method of claim 1 wherein the center portion (17) of the strip (16) is moved to provide the generally V-configuration of the strip so that the leg portions (33 and 34) of the strip (16) form an angle of not more than 45° with the opposite sides of the blank (15).

* * * * *